US008607702B1

(12) United States Patent
Donadio et al.

(10) Patent No.: US 8,607,702 B1
(45) Date of Patent: Dec. 17, 2013

(54) LOW ENERGY IGNITION SYSTEM FOR LARGE AND MEDIUM CALIBER AMMUNITION

(75) Inventors: Michael J. Donadio, West Milford, NJ (US); Harry L. Moore, Jr., Newton, NJ (US); Hardev Singh, Hillsborough, NJ (US); Matthew Sussmann, Sussex, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 188 days.

(21) Appl. No.: 12/981,682

(22) Filed: Dec. 30, 2010

Related U.S. Application Data

(60) Provisional application No. 61/295,206, filed on Jan. 15, 2010.

(51) Int. Cl.
*F42C 19/12* (2006.01)

(52) U.S. Cl.
USPC ..... 102/202.5; 102/202; 102/202.8; 102/205; 102/472

(58) Field of Classification Search
USPC ..... 102/202, 202.1, 202.2, 202.14, 205, 102/206, 202.5, 202.7, 202.8, 469, 470, 472
See application file for complete search history.

(56) References Cited

U.S. PATENT DOCUMENTS

| | | | | |
|---|---|---|---|---|
| 5,675,115 | A * | 10/1997 | Hershkowitz et al. | 102/202 |
| 6,644,204 | B2 * | 11/2003 | Pierrot et al. | 102/472 |
| 6,691,621 | B2 * | 2/2004 | Pierrot et al. | 102/275.2 |
| 6,703,580 | B2 * | 3/2004 | Brunet et al. | 219/121.52 |
| 6,740,841 | B2 * | 5/2004 | Brunet et al. | 219/121.52 |
| 7,059,249 | B2 * | 6/2006 | Chaboki et al. | 102/202.8 |
| 7,987,759 | B2 * | 8/2011 | Stark et al. | 89/1.11 |
| 2011/0056402 | A1 * | 3/2011 | Gustavsson et al. | 102/440 |
| 2011/0061555 | A1 * | 3/2011 | Gustavsson et al. | 102/440 |

* cited by examiner

*Primary Examiner* — James Bergin
(74) *Attorney, Agent, or Firm* — Michael C. Sachs

(57) ABSTRACT

A primary ignition system for large caliber ammunition which ignition system is less sensitive to unwanted ignition by conventional temperatures or conventional electrical signals or by stray electrostatic voltage electrical signals, or stray RF frequency signals. This ignition primer device begins the ignition sequence with applying a high voltage electrical pulse to a non-energetic element, specially coated with nano sized aluminum particles, to release and ionized discharge that generate a plasma in order to ignite an environmentally friendly ignition composition mix. The ignition composition is also comprised of aluminum water based nano material combined with oxidizer and binder. In the device's primer head assembly is a brass ignition pin pressed into a (non-electrically conductive) Torlon® material cup. The non-conductive Torlon® material acts as an insulator for the entire system.

4 Claims, 3 Drawing Sheets

LOW ENERGY IGNITION SYSTEM FOR LARGE AND MEDIUM CALIBER AMMUNITION

CROSS REFERENCE TO RELATED APPLICATIONS

This application claims benefit under 35USC119 (e) of the filing date of Provisional Application No. 61/295,206 filed Jan. 15, 2010, the entire file contents of which are incorporated by reference herein as though fully set forth

U.S. GOVERNMENT INTEREST

The inventions described herein may be made, used, or licensed by or for the U.S. Government for U.S. Government purposes.

BACKGROUND OF INVENTION

The Army and Navy have a need for less sensitive large caliber electric primers that will pass HERO (Hazards of Electromagnetic Radiation to Ordnance) requirements per MIL-STD 464B and ESD (electro static discharge) requirements per MIL-STD 331C, subtest F1, and also pass insensitive munition (IM) requirements. The primers are required to ignite large propellant beds across various temperatures with minimum differential pressure between the breach and the chamber. In both training and battle situations, munitions are continuously subjected to ESD discharge and stray RE (radio frequency) electrical signals. This Invention is designed to provide the user with a safer, more robust munition that is less prone to these hazards. An example of a use environment is for a M829A3 large caliber munition, or for an M831A1 training munition, but this invention can also be applied to a host of other large and medium caliber munitions.

BRIEF SUMMARY OF INVENTION

The invention provides an improved primary ignition system for large caliber ammunition which ignition system meets HERO and ESD requirements. This low energy ignition primer device begins the ignition sequence from the 24 volt supply (1) provided to a (PFN) Pulse Forming Network (2). The pulse width derived from the PFN delivers the ignition pulse to the primer head assembly (3) applying an electrical pulse of 1,900 volts; in 0.5 milliseconds; (up to approximately 400 amperes peak) to a specially coated non energetic element (5) in a chamber (6) in order to ignite an environmentally friendly ignition composition mix also located in chamber (6). A low temperature plasma is generated by the ionization of products discharged from the non energetic element that ignites the environmentally friendly ignition composition generating between 3500 to 4382 degrees Kelvin. The element coating comprises of non energetic material with a grain size approximately 0.1 nanometers. This extreme heat excites/reacts the aluminum pelletized composition to enter a phase change state that expands the pelletized aluminum based mixture igniting into latter chamber (10) where it is vented through the venting orifice plug (18). The mix is derived from a water based process to generate a stoichiometric nano based energetic insensitive material. The mix comprises of aluminum based nano sized material, combined with oxidizer, binders, and other gas developing agents then formed into an ESD (Electro Static Discharge) insensitive pellet. A venting orifice (18) serves to vent ignited nano based mixture from a closing plug (12) into a venting tube chamber (11), which is comprised of if a similar type material that finally serves to ignite the propellant bed found in the ammunition canister (14). The propellant bed ignited (14) is herein comprised of various double based granular and stick propellants. Once ignited the volumetric expansion of gases start the movement of the projectile (16).

In the device's primer head assembly is a brass ignition pin pressed into a (non-electrically conductive) Torlon® material cup. A circuit path ultimately going through to the grounded metal primer head enclosure (3) is enabled by having the special non energetic element installed so as to make connections within the slot of the ignition pin and reconnected to slip-in connection clips. The connection clips are the used as means to connect the element to the head, to complete a circuit. The non-conductive Torlon® material acts as an insulator for the entire system. By so acting as an insulator, electrostatic discharge values required to set off ignition are elevated, this creating a safer primary ignition composition. By using the special non energetic element in this configuration, radio frequency energies cannot easily couple to the system, this also creating a configuration less sensitive to premature detonation. Further, the relatively higher voltages/temperatures that would be required in this invention to set off an unwanted ignition, further makes this system less sensitive. The nano and other energetic/non-energetic materials used in the design of this system, make the system's operation more green, i.e., more environmentally friendly, by eliminating more toxic materials such as lead, and such as the benite strands that formerly were used in the propellant bed. Ignition timings are more predictable with pulse width delivered from a multi and single staged PFN that starts an instantaneous ignition unaffected by temperature as found in standard bridge wire conventional type systems that use lead based ignition compositions which are susceptible to harsh environments.

OBJECTS OF THE INVENTION

It is therefore an object of the present invention to provide a low energy ignition system means utilizing a less sensitive oxidized nano based energetic material as the primer material ignited eliminating the conventional type bridge wire.

It is another object of the present invention to provide a low energy ignition means wherein less sensitive and also more green, aluminum based nano sized material, combined with oxidizer, binders, and other gas developing agents then formed into an ESD (Electra Static Discharge) less sensitive pellet.

It is a further object of the present invention to provide a low energy ignition bridge wireless means wherein less sensitive and also more green nano type mixture is utilized in the primer body.

It is a yet another object of the present invention to provide a low energy ignition means utilizing nano type primer ingredients that are more green and more environmentally friendly.

These and other objects, features and advantages of the invention will become more apparent in view of the within detailed descriptions of the invention, the claims, and in light of the following drawings, wherein reference numerals may be reused, where appropriate, to indicate a correspondence between the referenced items. It should be understood that the sizes and shapes of the different components in the figures may not be in exact proportion and are shown here for visual clarity and for purpose of explanation. It is to be understood that the specific embodiments of the present invention that have been described herein are merely illustrative of certain applications of the principles of the present invention.

Numerous modifications may be made to the present invention described herein, without departing from the spirit and scope of the present invention.

DETAILED DESCRIPTION

Figure 1:
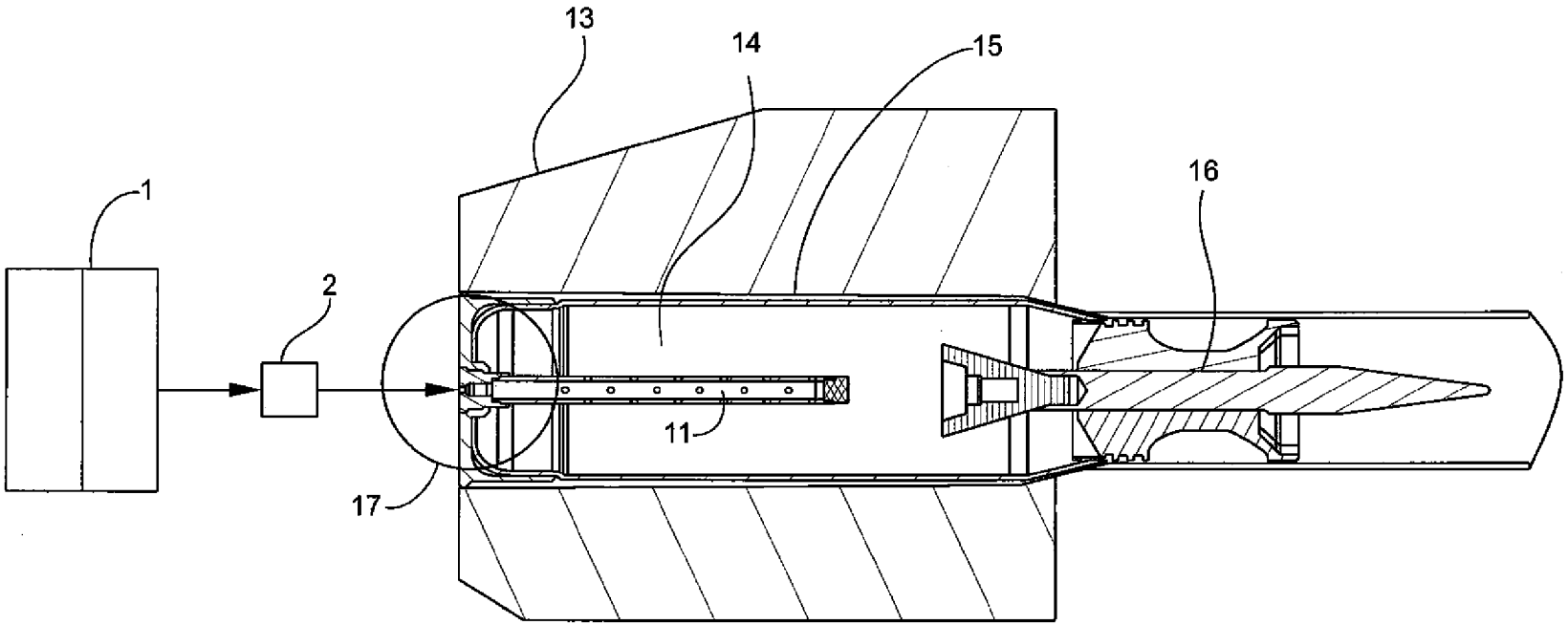
FIG. 1 shows an overall large caliber ammunition canister with primer pulse forming ignition system according to this invention.
Figure 2:
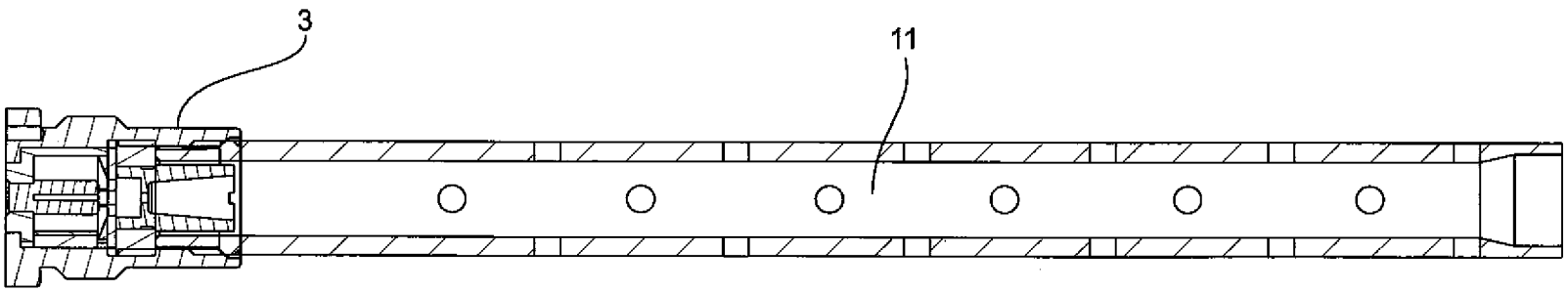
FIG. 2 shows a section of the primer ignition head and ignition tube parts of this invention.
Figure 3:
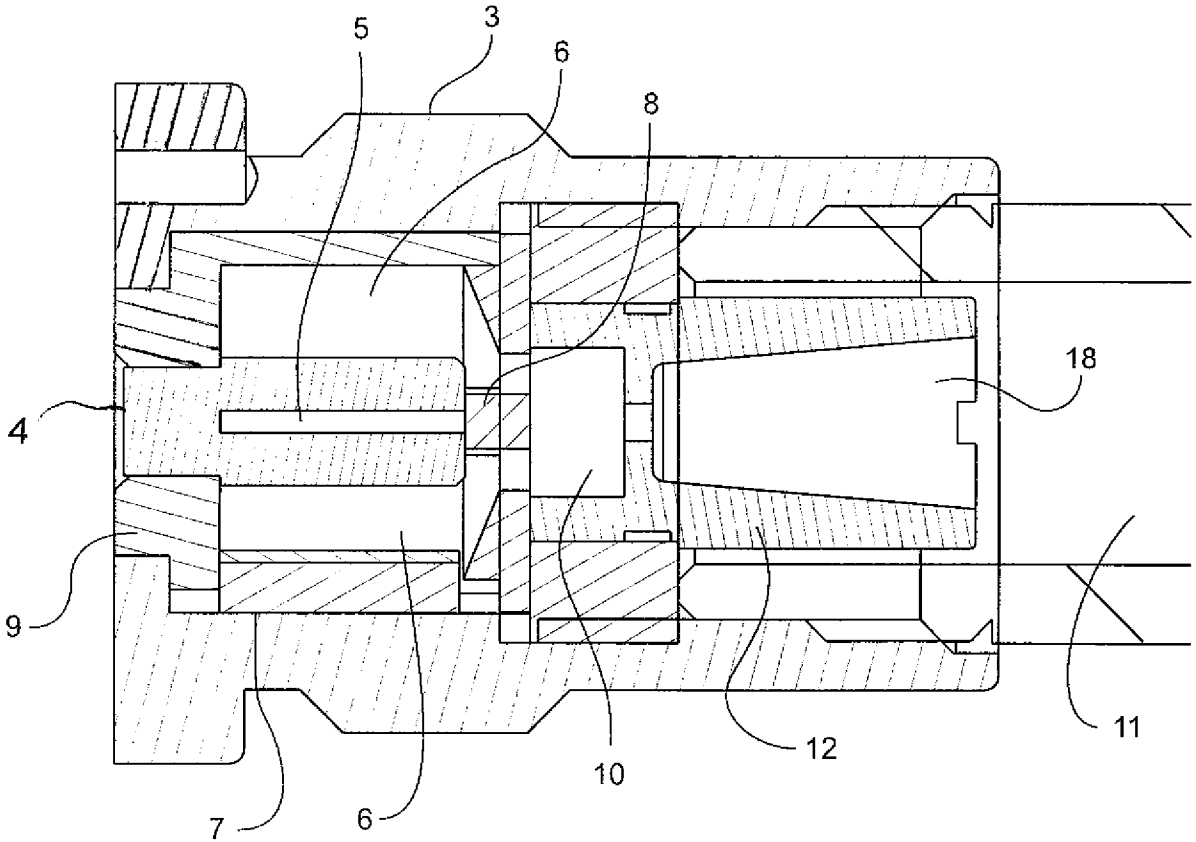
FIG. 3 shows a cross section view of the primer ignition head section according to the invention.

The diagrams in FIGS. 1-3 depict components according to this invention to launch an exemplary M831A1 training round across a range of temperatures. The low energy ignition (LEI) primer operation according to this invention begins the ignition sequence by applying an electrical pulse to a specially coated non energetic element 5 in chamber 6 to generate ionized discharge of plasma products in order ultimately to ignite an environmentally friendly chemical ignition composition mix in chamber 10; the mix is derived from a water based process to generate an oxidized nano based energetic material. Plasma is generated by ionized discharge of products released from such specially coated non energetic element 5. This is considered a primary ignition system that meets HERO and ESD requirements; it is not based on, e.g., conventional bridge wire ignition means. In FIG. 1, component 1 depicts two 12 volt batteries wired in series, providing 24 volts DC. Component 2 there depicts a pulse sharpening network (PSN), a single stage device (not shown here) designed to store voltage in a capacitor, from 24 to 2,000 volts. This potential will ultimately be released by a surrogate firing box (not shown here) like one that had been designed to simulate the firing control box in an MA1A2 SEP Abrams Tank. Within fixture 13, a cartridge case 15 is shown generally. The components found in circled number 17 of FIG. 1 are shown in much greater detail in FIG. 3, e.g. in FIG. 2, in the aft end of the cartridge, component 3 generally depicts an LEI primer head assembly according to this invention. In FIG. 3, there is shown a brass ignition pin 4 pressed into a (non-electrically conductive material) Torlon® cup 9. The special non energetic type of metallic covered element 5 is installed to make connections within the slot of the ignition pin 4 and reconnected to slip-in connection clips 7 which are meant to connect element 5 to head 3 to complete a circuit. Chamber 6 comprises non-electrically conductive ignition composition according to this invention. The composition is made up of aluminum based nano material combined with oxidizer and binder. The nano components are assembled by a water based process then installed inside the Torlon® cup in between element 5 and the firing pin 4. The non-conductive Torlon® material acts as an insulator for the entire system. By so acting as an insulator, ESD values required to set off ignition are elevated, creating a safer primary ignition composition. By using element 5 in this configuration, RF energy has a difficult time coupling to this system, thus creating a much safer configuration, less sensitive to premature detonation. Component 8 shows a venting orifice disc and pin retainer; it vents the nano based mixture from chamber 6 into the closing plug chamber 10 which is in the closing plug 12. It is loaded with 200-400 mg aluminum based nano material combined with oxidizer and binder mixture. Closing plug 12 also allows subsequent venting through vent 18 which leads into venting tube chamber 11, basically the final output of the igniter device of this invention. Venting tube chamber 11 is perforated with holes to facilitate ignition of a propellant bed 14 which now comprises nano sized aluminum particles, combined with oxidizer and binder. The bed formerly used to include a less green conventional 32.4 to 33.96 grams of MIL-B-45451 benite strands. Benite is made from less green materials nitrocellulose, potassium nitrate, sulfur, charcoal, and ethyl centralite. Benite is also more temperature sensitive. This invention tries to replace this material to make it more insensitive munition (IM) compliant for large caliber munitions. Ignition of the above mentioned propellant bed would then ordinarily lead to an acceleration of the ammunition projectile 15 depicted here generally including component 16.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A low energy ignition primer device for a large caliber ammunition projectile canister which canister further includes a propellant bed and a projectile, said device comprising:

a metallic primer head assembly which is electrically grounded;

an electrically insulating Torlon® cup pressed into an indented area of said primer head assembly;

a firing pin located in a cavity in said Torlon® cup to which firing pin an electrical pulse may be applied;

a first chamber in said primer head assembly comprising non-electrically conductive ignition composition made up of aluminum based nano material combined with oxidizer and binder, and;

a metallic coated non energetic element also in said first chamber, said non energetic element electrically connected to said firing pin, and said non energetic element also electrically grounded to said primer head assembly through aid of slip-in connection clips further located in said firing pin cavity, and;

wherein application of an electrical pulse to said firing pin causes activation of said non energetic element to generate ionized plasma which plasma in turn will ignite said non-electrically conductive ignition composition in said first chamber, and;

said device also including a venting orifice disc and pin retainer which can vent composition from said first chamber into a closing plug, said closing plug having a closing plug chamber with aluminum based nano material combined with oxidizer and binder, said closing plug chamber also leading to a vent, and said vent further leading to a venting tube chamber of said projectile canister, said venting tube chamber further containing said propellant bed, and; whereby ignition of such propellant bed leads to launch of said projectile from said canister.

2. The low energy ignition primer of claim 1 wherein the ignition process is begun by applying an electrical pulse to said firing pin.

3. The device of claim 1 wherein said propellant bed comprises nano-based energetic material including aluminum particles.

4. The device of claim 1 wherein the nano material comprises oxidized nano based energetic material.

* * * * *